US010428522B2

(12) United States Patent
Nanayakkara

(10) Patent No.: US 10,428,522 B2
(45) Date of Patent: Oct. 1, 2019

(54) CONSTRUCTION METALLIC TRAPEZOIDAL SYSTEMS

(71) Applicant: Pravin Nanayakkara, Boca Raton, FL (US)

(72) Inventor: Pravin Nanayakkara, Boca Raton, FL (US)

( * ) Notice: Subject to any disclaimer, the term of this patent is extended or adjusted under 35 U.S.C. 154(b) by 0 days.

(21) Appl. No.: 15/714,773

(22) Filed: Sep. 25, 2017

(65) Prior Publication Data

US 2019/0093360 A1 Mar. 28, 2019

(51) Int. Cl.

| | |
|---|---|
| ***E04C 3/07*** | (2006.01) |
| ***E04B 1/16*** | (2006.01) |
| ***E04B 1/24*** | (2006.01) |
| ***E04B 5/29*** | (2006.01) |
| ***E04C 3/28*** | (2006.01) |
| *E04C 3/04* | (2006.01) |
| *E04G 11/38* | (2006.01) |

(52) U.S. Cl.

CPC ..... *E04C 3/07* (2013.01); *E04B 1/165* (2013.01); *E04B 1/2403* (2013.01); *E04B 5/29* (2013.01); *E04C 3/28* (2013.01); *E04B 2001/2448* (2013.01); *E04B 2001/2481* (2013.01); *E04C 2003/0465* (2013.01); *E04C 2003/0473* (2013.01); *E04G 11/38* (2013.01)

(58) Field of Classification Search

CPC ..... E04C 3/07; E04C 3/28; E04C 2003/0465; E04C 2003/0473; E04B 1/165; E04B 1/2403; E04B 2001/2448; E04B 2001/2481; E04B 5/29; E04G 11/38

See application file for complete search history.

(56) References Cited

U.S. PATENT DOCUMENTS

| | | | | |
|---|---|---|---|---|
| 2,730,211 A * | 1/1956 | Findlay | E04C 3/07 | 52/677 |
| 4,825,610 A * | 5/1989 | Gasteiger | E04B 2/825 | 52/217 |
| 4,993,095 A * | 2/1991 | Lautensleger | E01D 2/04 | 14/13 |
| 5,904,025 A * | 5/1999 | Bass | E04G 23/0218 | 52/167.3 |
| 5,921,053 A * | 7/1999 | Callahan | E04C 3/07 | 52/376 |

(Continued)

FOREIGN PATENT DOCUMENTS

| | | | | |
|---|---|---|---|---|
| DE | 1784021 A1 * | 7/1971 | A47B 47/0008 | |
| EP | 0640197 B1 * | 5/2001 | E04B 1/2403 | |

(Continued)

*Primary Examiner* — Babajide A Demuren
(74) *Attorney, Agent, or Firm* — Melvin K. Silverman

(57) ABSTRACT

A construction system definable in terms of an X, Y, and Z coordinate axes which provides a first part having a hollow four-walled web elongate in the Z axis, having a securement flange on the upper XZ base of the elongate Z axis member; and a second part having at least one open end for complemental engagement of the first part wherein the second part may fit over distal ends of said first part in which a cross-section of the second part is generally that of the first part, but wide and tall enough to allow the first part to slip within the second part, and said second part having an opposite end of said opening, wherein said second part securing the first part to a structural support.

43 Claims, 8 Drawing Sheets

(56) References Cited

U.S. PATENT DOCUMENTS

| | | | | |
|---|---|---|---|---|
| 6,415,576 | B1 * | 7/2002 | Stromback | E04C 3/07 428/35.8 |
| 6,802,170 | B2 * | 10/2004 | Davis | E04C 3/07 29/897.31 |
| 8,720,154 | B1 * | 5/2014 | Horne | E04B 1/24 52/236.3 |
| 2002/0116891 | A1 * | 8/2002 | Waldrop | E04B 2/7818 52/632 |
| 2003/0126827 | A1 * | 7/2003 | Davis | E04C 3/07 52/843 |
| 2007/0113506 | A1 * | 5/2007 | Denadel | E04C 3/07 52/481.1 |
| 2009/0308016 | A1 * | 12/2009 | Strickland | E04C 3/07 52/636 |
| 2011/0036052 | A1 * | 2/2011 | Callahan | E04C 3/07 52/843 |
| 2011/0281065 | A1 * | 11/2011 | Durney | E04B 2/78 428/136 |
| 2013/0232911 | A1 * | 9/2013 | Stal | E04C 3/293 52/837 |
| 2018/0058067 | A1 * | 3/2018 | Lake | E04B 1/2403 |

FOREIGN PATENT DOCUMENTS

| | | | | |
|---|---|---|---|---|
| FR | 2744473 | A3 * | 8/1997 | E04B 2/7457 |
| FR | 2834741 | A1 * | 7/2003 | E04B 7/024 |
| GB | 2376281 | A * | 12/2002 | E04B 1/2403 |
| JP | 5515566 | B2 * | 6/2014 | B21D 5/015 |

* cited by examiner

CONSTRUCTION METALLIC TRAPEZOIDAL SYSTEMS

BACKGROUND OF THE INVENTION

The present invention relates to metallic surfaces of trapezoids of types used within frame of residential, commercial or industrial structures, and is an improvement of the invention of my U.S. Pat. No. 6,988,347, entitled Metal Stud Frame Element.

Historically frames of such structures were formed of steel and in the case of bearing structures; it was common to use a steel bar.

The use of vertical light gauge steel and studs, in lieu accomplish internal framing within a structure is also well known in the art. It is however not known to employ thin gauge vertical surfaces in combination with exterior wall framing in which vertical studs operate to define an offset the distance between an exterior and which is secured to one surface of such a steel surface.

A need for such surface steel gauges has arisen as a consequence of rapid on-site assembly high techniques employing thin external surfaces which have developed in the construction arts. The present invention therefore relates to such vertical metallic elements in which a one rectilinear surface thereof may operate as a process of an exterior surface, its base and/or load bearing resultant.

SUMMARY OF THE INVENTION

A construction system definable in terms of an X, Y, and Z coordinate axes which provides a first part having a hollow four-walled web elongate in the Z axis, having a securement flange on the upper base of the elongate Z axis member; and a second part having at least one open end for complemental engagement of the first part wherein the second part may fit over distal ends of said first part in which a cross-section of the second part is generally that of the first part, but wide and tall enough to allow the first part to slip within the second part, and said second part having an opposite end of said opening, wherein said second part securing the first part to a structural support.

Further provided is, the first part having a hollow four-walled web having a lower XZ base and an upper XZ base along an elongate Z axis connected by two opposing webs on the YZ planes.

Additionally provided is, a channel in said Z axis in the center of said upper XZ base and a flange extending upwardly in a positive Y direction from said upper XZ base wherein said flange formed from one YZ surface pressed against an opposing YZ surface, and said flange having a series of YZ cut-outs and said cut-outs having a lower edge and an upper mouth with the lower edge being of longer length than the length of the upper mouth. Yet additionally provided is a Y height of said cut out selected from the range of about part of the way down from the upper mouth to the lower edge to all of the way down from the upper mouth to the lower edge. Said flanges transfer shear force (shear flow) into the concrete it fixes to. Said cut-outs may be in a range of geometric shapes, including, circular, square, dovetail, rectangular, etc.

Further provided is a series of substantially circumferential holes occurring toward the upper edges of the YZ web where said series of elements existing along the entire Z distance.

Yet further provided in the system is an XZ cross-section, which may be in the form of a trapezoid, inverted trapezoid, square, rectangle, or similar shape.

Additionally provided are possible structural supporting members attached to the lower XZ base, which may be in the form of a rod, such as a rebar, plate fastened to the surface of the base, such as a steel plate, with or without steel sidewalls, or ribs in the lower XZ base.

It is an object of the present invention to provide metallic structural elements which may be used in a vertical or horizontal capacity, including use within walls, ceilings, and roofs.

It is yet another object to provide a four-walled elongate of the above type which can function as an interior to exterior offsets.

It is accordingly an object of the invention to provide for both cast in place and pre-cast members to support concrete surfaces, such as a floor, roof, or wall.

It is yet another object to provide a four-walled member, capable of being rolled into shape, and cut to a desired length.

It is yet a further object to provide a multi-part system where a second part may complementally engage a first part, and allow the first part to be cut to a desired length as above.

The above and yet other objects and advantages of the invention will become apparent from the hereinafter set forth Brief Description of the Drawings, Detailed Description of the Invention, and claims appended herewith.

DETAILED DESCRIPTION OF THE INVENTION

There is provided a construction system which provides terms of an X, Y and Z coordinate system, this particularly as is shown with FIGS. 1, 2, 3, 3A and 4 herewith.

Figure 13:
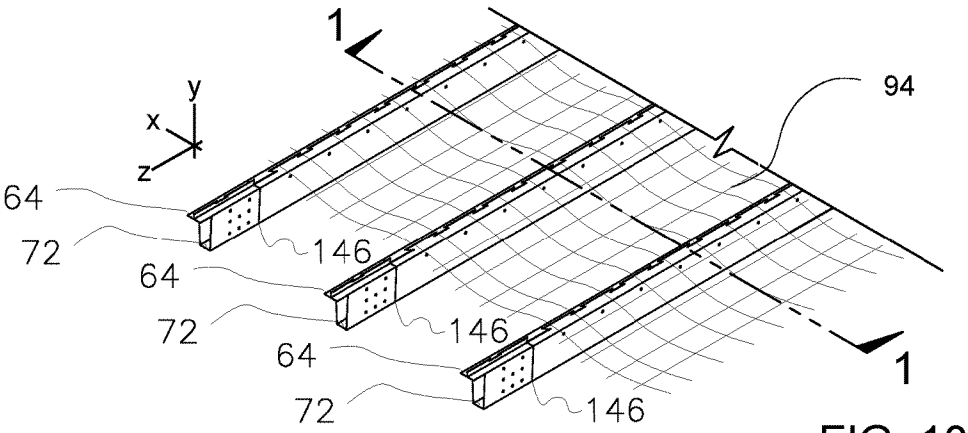
FIG. 13 is a perspective view of multiple members in the system.
Figure 14:
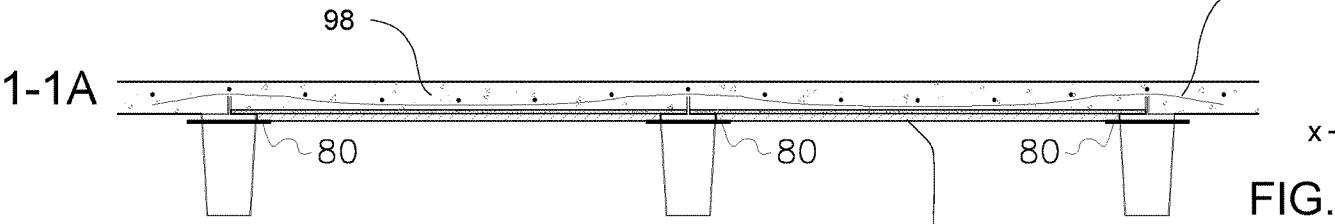
FIG. 14 is an XY cross sectional view of the system of FIG. 13 with form-board.
Figure 15:
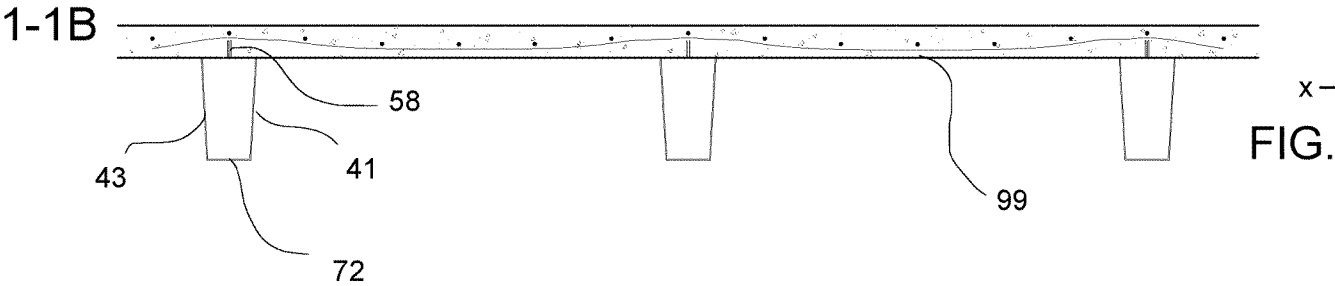
FIG. 15 is an additional XY cross sectional view of the system of FIG. 14 with form-board removed.

The system may be used in a horizontal orientation in use, for example, with flooring, ceilings, or roofing, and may be produced using material, such as steel, fiber glass, carbon fiber, etc. The system may also be used vertically, for example, in wall construction. One may secure the members 40 and 60 in use with concrete or similar material by fitting an opening 74 of a second part of the system 60 over a cross-sectional end 47 of a first part of the system 40 at each distal end, and casting the concrete as shown in FIGS. 13, 14, and 15 over center flanges 58. A securing member 80, may pass through the members to hold up a material thereof supporting said concrete for cast-in-place uses as shown in FIG. 14. Said flanges 58 transfer shear force (shear flow) into the concrete it fixes to In other words, end members 60 are placed at each end of the four-walled member. The end member 60 allows the joists 30, made up of the first part 40 and second part 60 to sit on the surface of a structural support, such as a pier, beam, joist, stud, or wall. Once joist members 30 are placed into their location, a form-work support pin 80 is placed, and form board 96 is placed on top of the pins. See FIGS. 13 and 14. From there a wire mesh 94 is laid on top of the form board 96. From there, concrete 98 is poured over top of the form board, and once hardened, the pins 80 can be removed and the form board 96 lowered, exposing the newly hardened concrete lower surface 99. Supported by the four-walled members.

Figure 1:
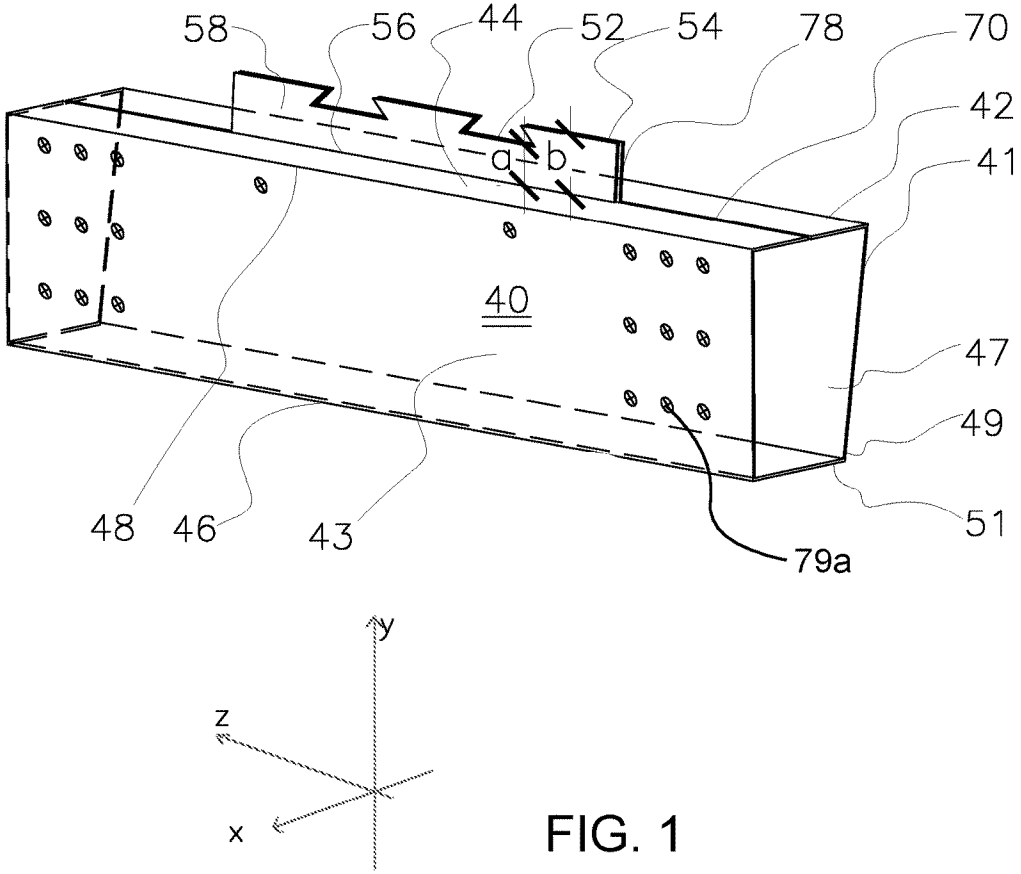
FIG. 1 is a perspective view of a first part of the system including a flange with cut-outs.

In FIG. 1 is seen sidewall 43, on a YZ plane, between edges 46 of a lower XZ base and 48 of an upper XZ base. Edges 46, 49, and 51 define the lower four-sided XZ base. An upper XZ base is made up of walls 42 and 44 and separated in to two halves by channel 70. The four-walled member is elongate of cross-sectional opening 47 along a Z axis. As may be seen, the upper XZ bases also provide for YZ flange portions 58 that begin at lower edge 56 and ascend upwardly in a Y direction to edge 54, and is elongate in the Z axis until end point 78. Also shown, are cut-outs 53 with a lower cut-out edge 52. The distance between lower edge 56 and lower cut-out edge 52 is denoted as 'a'. Similarly, the distance between lower edge 56 and upper edge 54 is denoted as t'. It may be noted that in a given embodiment a YZ flange 58 may be either a solid member or of separate parallel pressed members, see cross-section of FIG. 3. The result thereof is the interdigital YZ structure may also be seen in regard to elements 52, 54, and 58. Said cut-outs may be in a range of geometric shapes, including, circular, square, dovetail, rectangular, etc.

In an ideal manufacture, the member 40 will begin as a continuous solid sheet of metal, and will be rolled into for on a continuous machine, allowing members to be cut into varying lengths.

Figure 2:
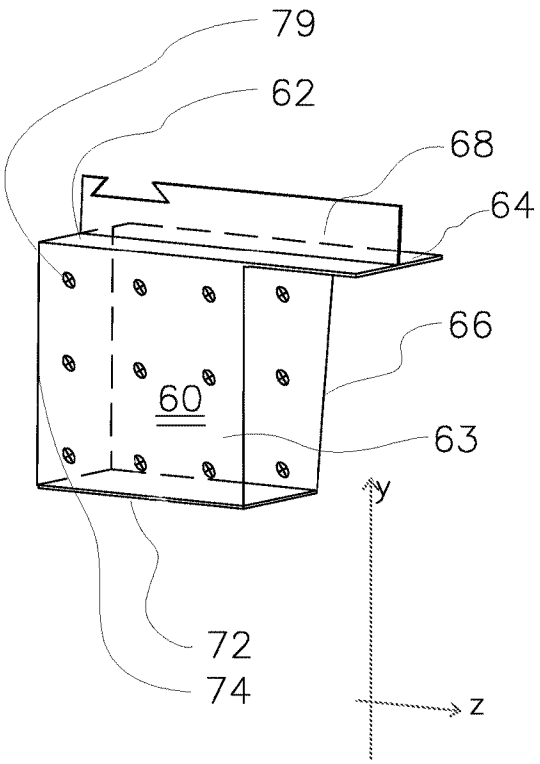
FIG. 2 is a perspective view of a second part of the system of FIG. 1.

FIG. 2 is the second part of the system. The member 60 of the second part slip-fits over the member 40 of a first part. The member of the second part 60 is of the same proportions of the first part with a slightly larger cross-section to allow the four-sided entrance 47 of the first part to slide in to the opening 74 of the second part. Sidewall 63 of the second part abuts the outside of sidewall 43 of the first part. Sidewall 66 abuts sidewall 41. Lower XZ base 72 of the second part abuts the underside of lower XZ base 72 of the first part. Wall 62 of the second part abuts the outside of wall 42 of the first part. Wall 64 of the second part abuts the outside of wall 44 of the first part. Flange 68 of the second part will operate in the same fashion as flange 58 of the first part. Areas for screws 79 exist on the sidewalls if the second part of the system, and complement area 79*a* on the first part of the system. Screws allow the first part of the system to fasten to the second part of the system.

Figure 3A:
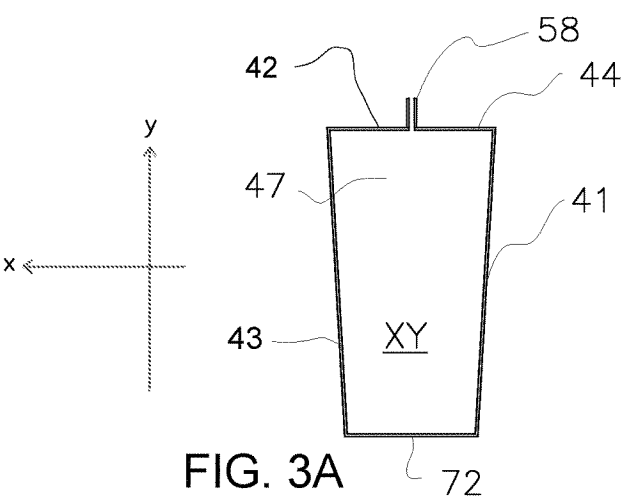
FIG. 3A is an XY cross-sectional view of FIG. 4 at 3A-3A
Figure 3:
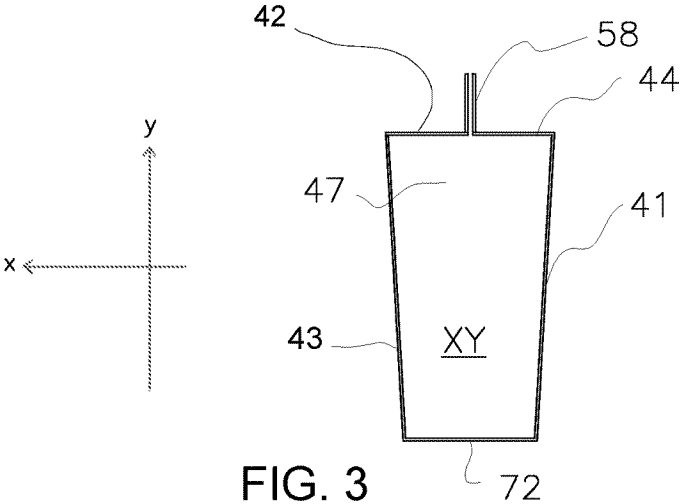
FIG. 3 is an XY cross-sectional view of FIG. 4 at 3-3
Figure 4:
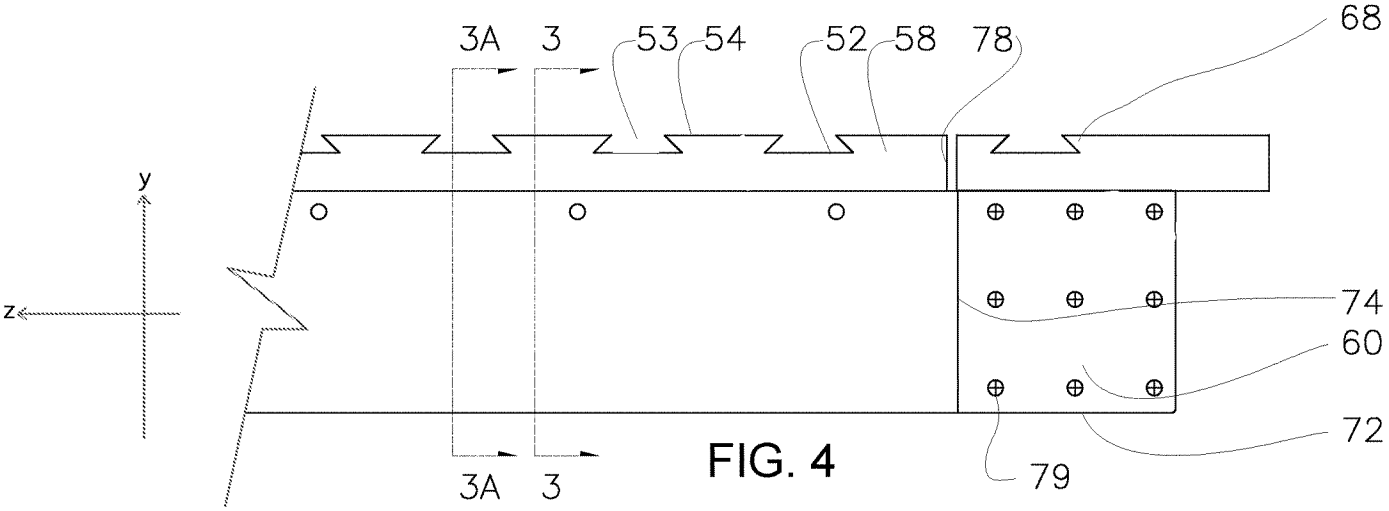
FIG. 4 is a side elevation depicting the insertion of the first part within a second part of the system.

FIG. 3 shows a cross-section of FIG. 4 of the first part of the member. Noticed are YZ sidewalls 43 and 41, Upper XZ base of walls 42 and 44, and lower XZ base 72. FIG. 3A shows a cross-section of FIG. 4 similar to FIG. 3, but a comparison between the two shows a difference in flange heights, showing edges 54 in FIG. 3, and 52 in FIG. 3A, and in reference to cross-sectional positions in FIG. 4.

FIG. 4 shows an XZ side elevation of the first and second part of the system of FIGS. 1 and 2, respectively, engaged in a position where the second part is fitted over the first part of the system.

There is provided a second embodiment of a construction system provided in terms of an X, Y, and Z coordinate system. This is particularly shown in FIGS. 5, 6, and 7.

The primary differences from the first embodiment to the second embodiment are the nature of the flanges 58 and 158. As may be seen in the second embodiment, edge 152 is of the same height as 142 and 144. That is, there is no height to element 152 of FIG. 5 as compared to element 52 of FIG. 1.

Figure 5:
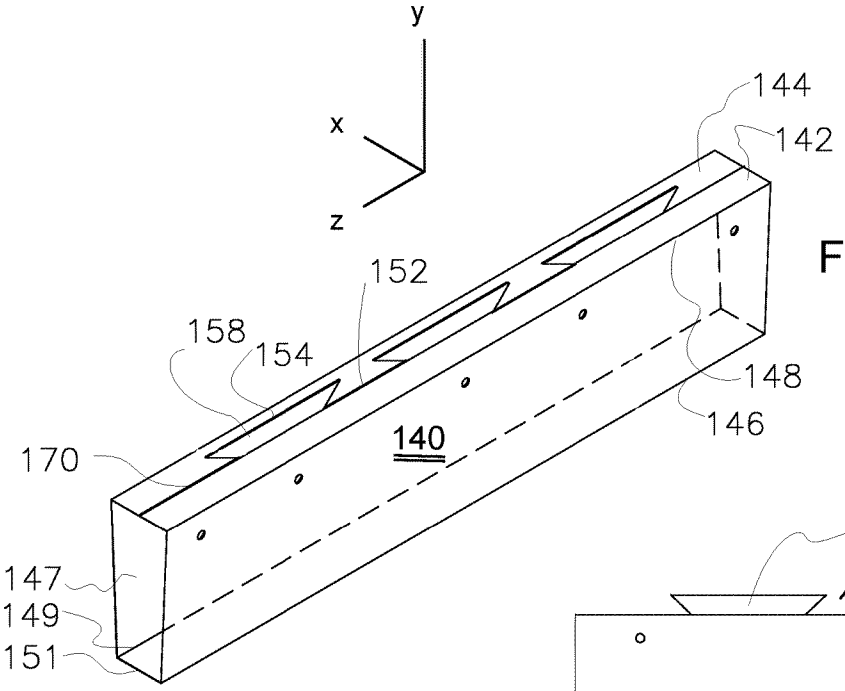
FIG. 5 is a perspective view of a modified first part of the system.

FIG. 5 is a view similar to that of FIG. 1 showing member 140. Edges 146 and 148 are seen at an upper YZ plane, while the lowermost edges 146 and 149 at lower back such with respect of a four-walled member, elongate in the area 147. The uppermost area is determined by upper XZ base of walls 142 and 144. Also, as may be noted, edges of 146 and opposite edge 149 of the cross-section ends in area 147 and, therefrom, between area of Y, and hollow of upper XY faces and between 142 and 144. As may be seen, the upper XZ base also provides for the four-walled member with YZ portions that are shown at surfaces 158. See FIG. 5. A resultant edge 154 also includes rigid area 158. This, therefore, operates directly against one XZ wall of 142 and another wall XZ of 144 of FIG. 5.

Figure 6:
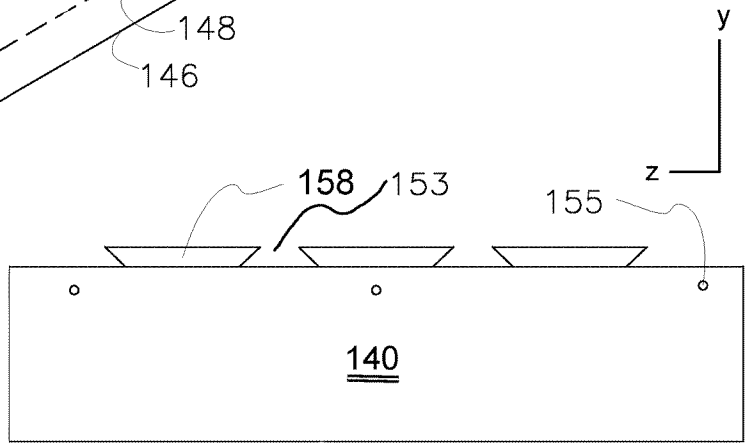
FIG. 6 is a YZ elevation view of the system in FIG. 5

In FIG. 6 is shown side, YZ elevation view of FIG. 5, and shown elements 140, cut-out 153, flange 158, and distal hole element 155 thereof.

Figure 7:
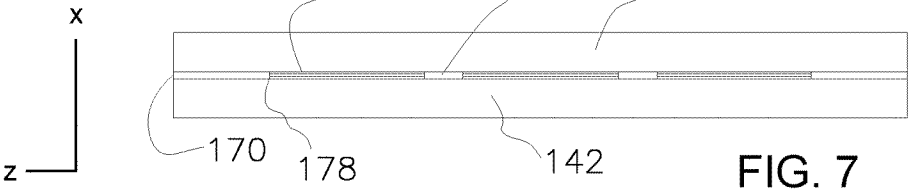
FIG. 7 is an XZ top view of the system in FIG. 5
Figure 8:
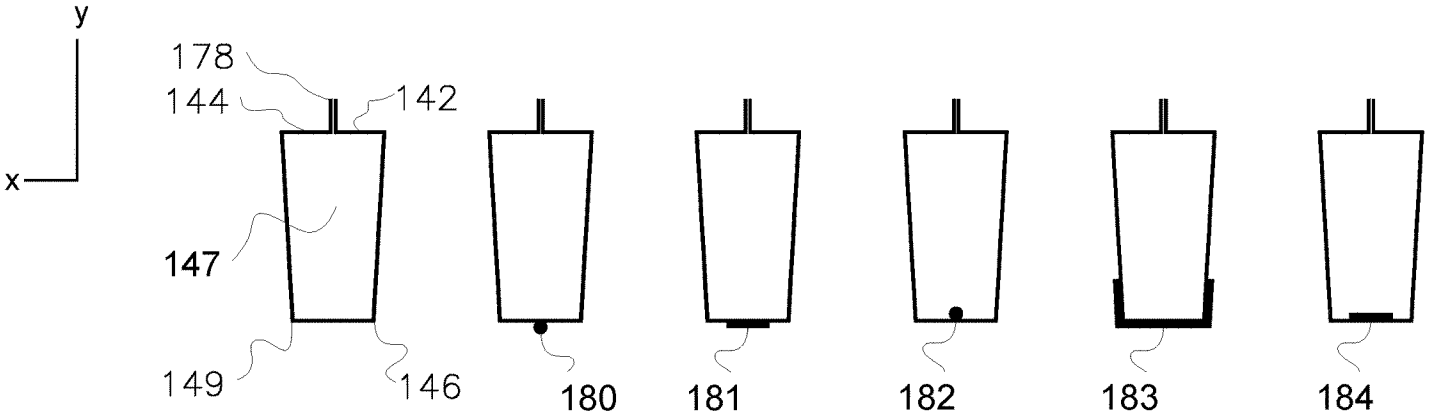
FIG. 8 shows XY trapezoidal cross-sections of the system.
Figure 9:
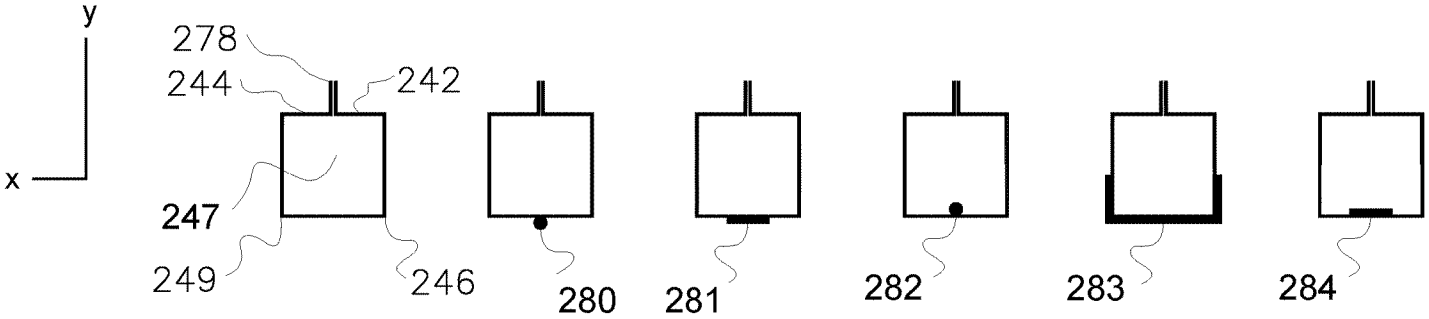
FIG. 9 shows XY square cross-sections of the system.
Figure 10:
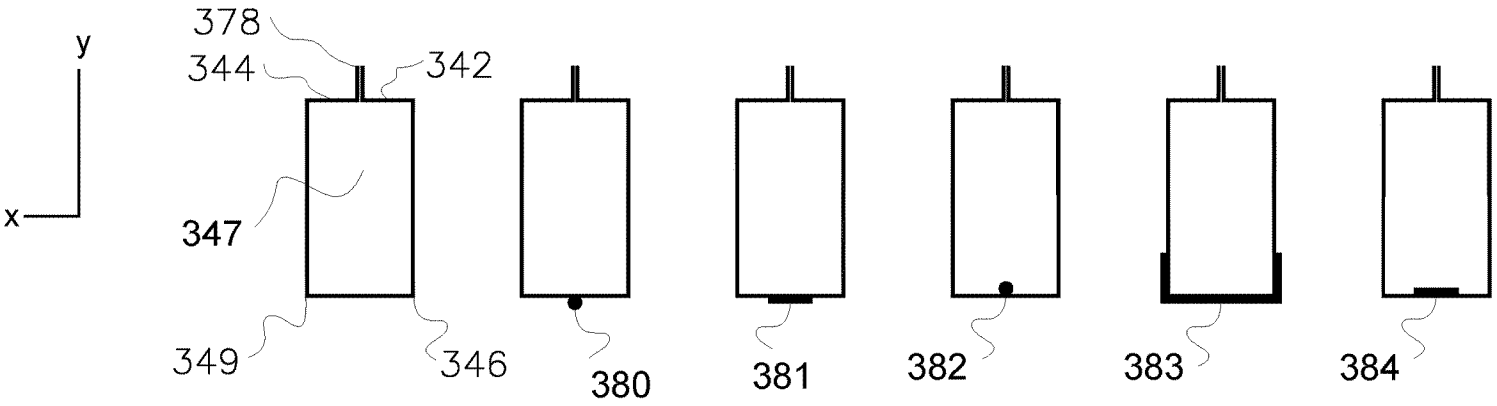
FIG. 10 shows XY rectangular cross-sections of the system.
Figure 11:
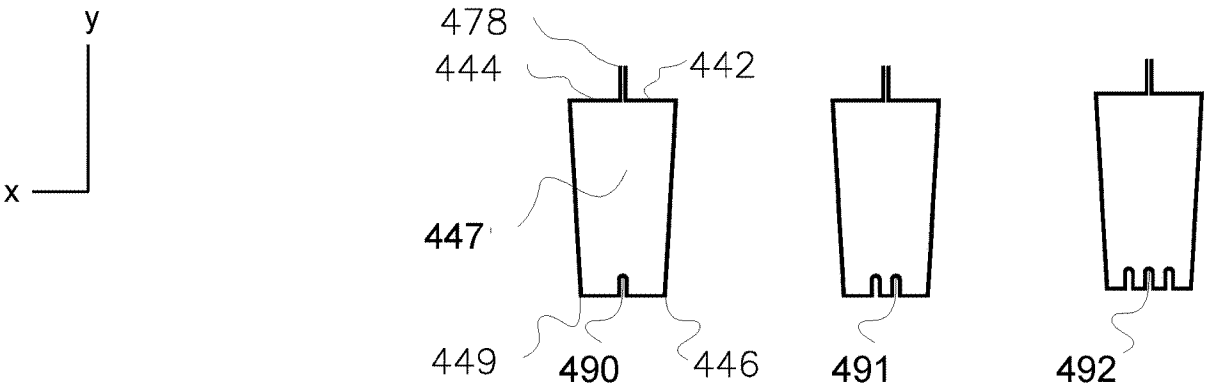
FIG. 11 shows other trapezoidal cross-sections of the system.
Figure 12:
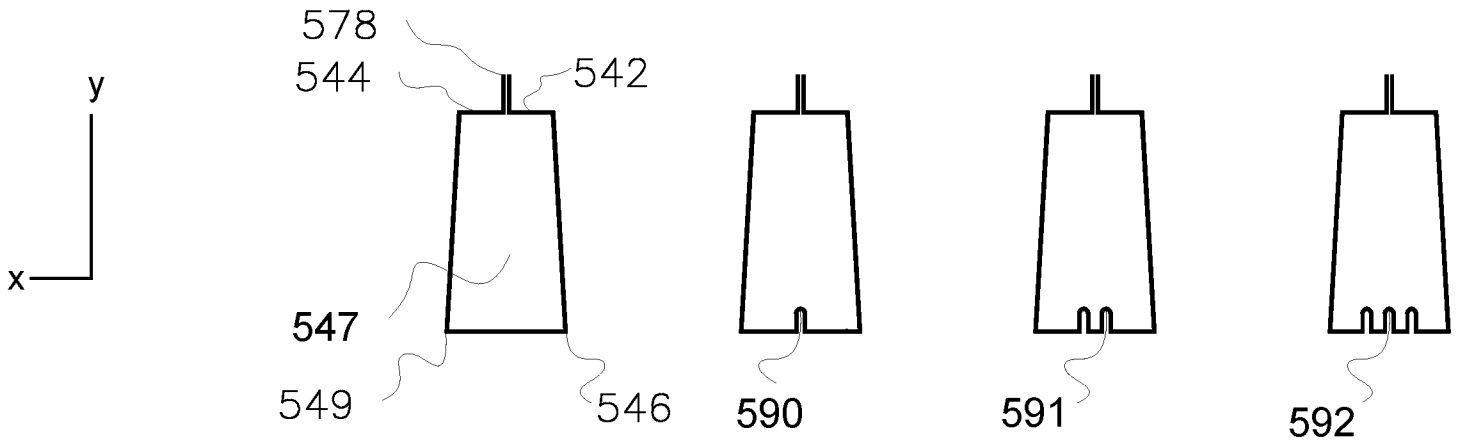
FIG. 12 is an inverted XY trapezoidal cross-section of the system.

In FIG. 7 is shown top view, elevation view of FIG. 5, and shown elements 142, 144, 152, 154, channel 170, and element 178 thereof In FIGS. 8, 9, 10, 11, and 12 are shown different cross sections of the four-walled members. FIG. 8 shows the XY cross-section as a trapezoid with upper XZ base of larger width than lower XZ base. FIG. 9 shows the XY cross-section as a square with upper and lower XZ base of equal width, and right and left sides of equal width to each other as well as upper and lower base. FIG. 10 shows a XY cross-section similar to FIG. 9, but with sidewalls larger in length than in width, resembling that of a rectangle. FIG. 11 is a trapezoidal cross-section similar to FIG. 8. FIG. 12 is similar to the cross section of FIG. 11, but as an inverted trapezoid, having a lower XZ base larger than an upper XZ base.

Additionally shown in FIGS. 8, 9, and 10, are means for increasing the structural strength of the lower XZ base of the four-walled member. As shown in FIG. 8, element 180 is a steel rod, similar to rebar, mounted directly to the bottom and elongate in the Z axis of the XZ base of the four-walled member. Similar elements 280 and 380 can be seen in FIGS. 9 and 10 respectively. Element 181 is similar to element 180, but is a steel plate elongate in the Z axis and mounted to the under-side of the lower XZ base. Element 182 is a steel rod, similar to element, but mounted to the inside lower XZ base of the four-walled member. Element 183 is a u-shaped, three-walled, steel plate that is secured to the under side of the lower XZ base. Element 184 is a steel plate similar to that of 181, in that it is elongate in the Z axis, but is fastened to the inside lower XZ base of the four-walled member.

Each of these structural securements in FIG. 8 are presenet in the embodiments in FIGS. 9 and 10, that is, element 180 corresponds with elements 280 and 380. Element 181 corresponds with elements 281 and 381. Element 182 corresponds with elements 282 and 382. Element 183 corresponds with elements 283 and 383. Element 184 corresponds with elements 284 and 384.

Shown in FIGS. 11 and 12, are different variations of ribs, elements 490, 491, 492, 590, 591, 592, that may be shaped within the lower XZ base of the four-walled member. These ribs offer structural securement of the member by increasing the area of the lower XZ base by giving it more surface area to distribute the stresses, which in turn gives the member a higher strength.

FIGS. 13, 14, and 15 show the system in use. FIG. 13 shows several of the four-walled members with a wire mesh 94 over top. FIG. 14 shows a cross-section, 1-1, of the system with support pins 80 holding up a form boards, and wire mesh 94 over top of that. FIG. 15 shows how the cross-section will appear once the form pins and form boards are removed, exposing the concrete.

Figure 16:
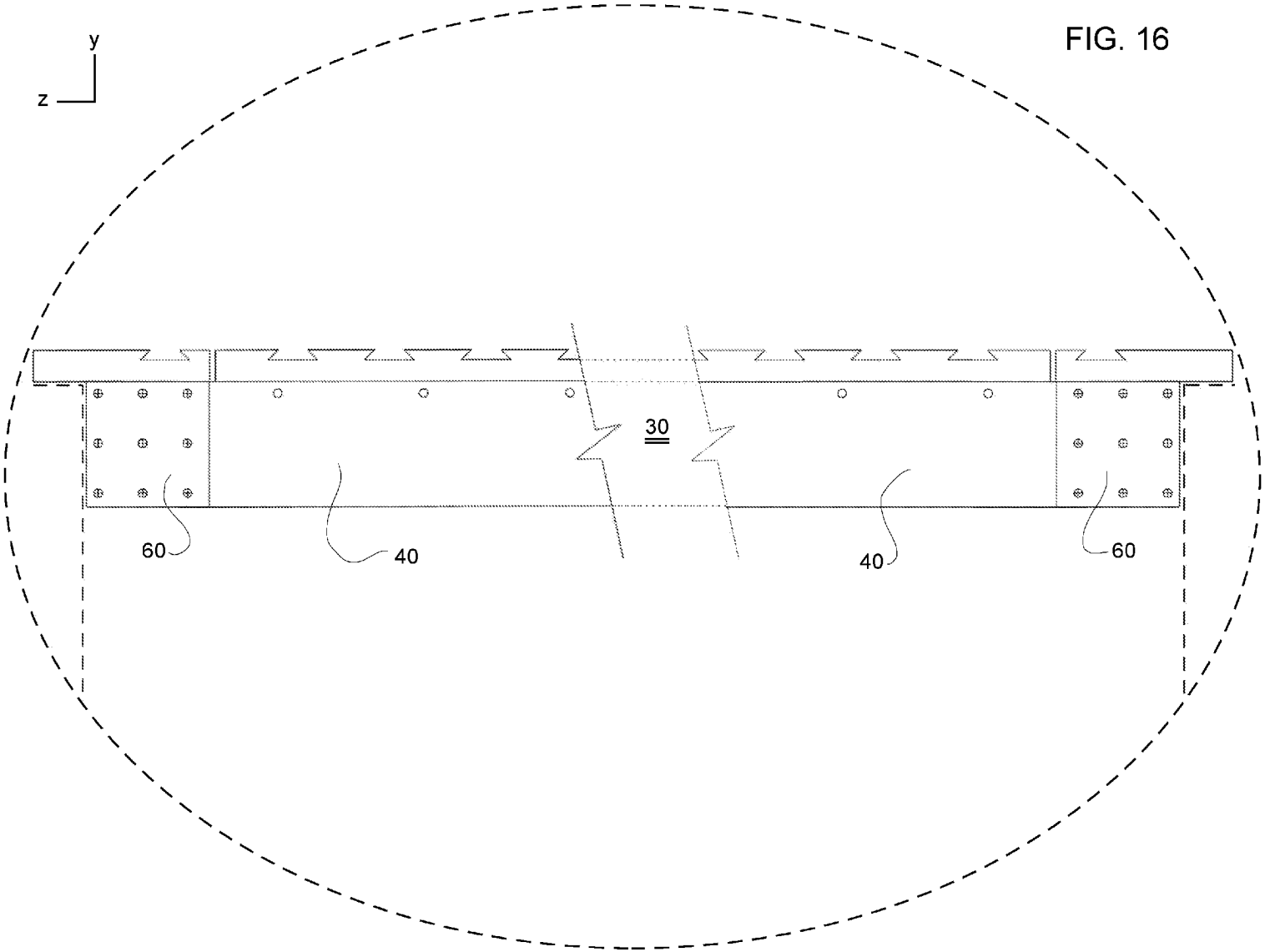
FIG. 16 is an YZ side elevation depicting the full joist of the system.

FIG. 16 further shows the system, of a first part 40 engaging with a second part 60 and forms a joist, which then sits on a structural support, such as a pier, beam, joist, stud, or wall. The joist forms a side elevation of a widened 'T'. The sides of the 'T' allow the joist to sit on the structural supports. In other words, the second part 60 has elements opposite of the opening which allow the member 60 to attach member 40 to the structural support.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. A construction system definable in terms of an X, Y, and Z coordinate axes structure, the system comprising:

(a) a first part having a hollow four-walled web elongate in the Z axis, having a securement flange on the upper XZ base of the elongate Z axis member;

(b) a second part having at least one open end for complemental engagement of the first part wherein the second part may fit over distal ends of said first part in which a cross-section of the second part is generally that of the first part, but wide and tall enough to allow the first part to slip within the second part, and said second part having an opposite end of said opening, wherein said second part securing the first part to a structural support;

(c) said first part having a hollow four-walled web having a lower XZ base and an upper XZ base along an elongate Z axis connected by two opposing webs on the YZ planes;

(d) a channel in said Z axis in the center of said upper XZ base;

(e) a flange extending upwardly in a positive Y direction from said upper XZ base;

(f) said flange formed from one YZ surface pressed against an opposing YZ surface, and said flange having a series of YZ cut-outs;

(g) said cut-outs having a lower edge and an upper mouth; and (h) a Y height of said cut out selected from the range of about part of the way down from the upper mouth to the lower edge to all of the way down from the upper mouth to the lower edge.

2. The system as recited in claim 1, further comprising:
said YZ cut-outs having a the lower edge of said YZ cut-outs at the upper XZ base of the hollow four-walled member.

3. The system as recited in claim 1, further comprising:
said cut-outs having a lower edge about halfway between the mouth of the cut-out and the upper XZ base of the hollow four-walled member.

4. The system as recited in claim 1, wherein said cut-outs are square in shape.

5. The system as recited in claim 1, wherein said cut-outs are dovetail in shape.

6. The system as recited in claim 1, wherein said cut-outs are circular in shape.

7. The system as recited in claim 1, wherein said cut-outs are rectangle in shape.

8. The system as recited in claim 1, further comprising:
a series of substantially circumferential holes occurring toward the upper edges of the YZ web; and
said series of elements existing along the entire Z distance.

9. The system as recited in claim 2, further comprising:
an XZ cross-section in the form of a trapezoid; and
said trapezoidal cross-section having an XZ base larger in width than a lower XZ base.

10. The system as recited in claim 9, further comprising:
a structural securing member fastened to the lower XZ base and elongate in the Z axis.

11. The system as recited in claim 10, comprising:
said securing member comprises a rod secured to the underside of the lower XZ base and elongate in the Z axis.

12. The system as recited in claim 6, comprising:
said securing member comprises a rod secured to the inside surface of the lower XZ base and elongate in the Z axis.

13. The system as recited in claim 10, comprising:
said securing member comprises a steel plate fastened to the under side of the lower XZ base and elongate in the Z axis.

14. The system as recited in claim 10, comprising:
said securing member comprises a steel plate fastened to the inside surface of the lower XZ base and elongate in the Z axis.

15. The system as recited in claim 10, further comprising:
said securing member comprises a steel U-shaped plate fastened to the under side of the lower XZ base and elongate in the Z axis; and said steel U-shaped plate having a lower XZ base and two sidewalls.

16. The system as recited in claim 9, further comprising:
at least one rib in the lower XZ base; and
said at least one rib elongate in the Z axis.

17. The system as recited in claim 2, further comprising:
an XZ cross-section in the form of a square, said square cross-section having an XZ base equal in width to a lower XZ base; and
YZ webs equal in height to that of the width of the upper and lower XZ base.

18. The system as recited in claim 17, further comprising:
a structural securing member fastened to the lower XZ base and elongate in the Z axis.

19. The system as recited in claim 18, further comprising:
said securing member comprises a rod secured to the under side of the lower XZ base and elongate in the Z axis.

20. The system as recited in claim 13, further comprising:
said securing member comprises a rod secured to the inside surface of the lower XZ base and elongate in the Z axis.

21. The system as recited in claim 18, further comprising:
said securing member comprises a steel plate fastened to the under side of the lower XZ base and elongate in the Z axis.

22. The system as recited in claim 18, further comprising:
said securing member comprises a steel plate fastened to the inside surface of the lower XZ base and elongate in the Z axis.

23. The system as recited in claim 18, further comprising:
said securing member comprises a steel U-shaped plate fastened to the under side of the lower XZ base and elongate in the Z axis; and said steel U-shaped plate having a lower XZ base and two sidewalls.

24. The system as recited in claim 19, further comprising:
at least one rib in the lower XZ base; and
said at least one rib elongate in the Z axis.

25. The system as recited in claim 2, further comprising:
an XZ cross-section in the form of an inverted trapezoid;
said trapezoidal cross-section having an XZ base lesser in width to a lower XZ base; and
said trapezoidal cross-section having YZ webs greater in height dimensions to that of the width dimensions of the upper and lower XZ base.

26. The system as recited in claim 25, further comprising:
a structural securing member fastened to the lower XZ base and elongate in the Z axis.

27. The system as recited in claim 26, further comprising:
said securing member comprises a rod secured to the under side of the lower XZ base and elongate in the Z axis.

28. The system as recited in claim 26, further comprising:
said securing member comprises a rod secured to the inside surface of the lower XZ base and elongate in the Z axis.

29. The system as recited in claim 26, further comprising:
said securing member comprises steel plate fastened to the under side of the lower XZ base and elongate in the Z axis.

30. The system as recited in claim 26, further comprising:
said securing member comprises a steel plate fastened to the inside surface of the lower XZ base and elongate in the Z axis.

31. The system as recited in claim 26, further comprising:
said securing member comprises a steel U-shaped plate fastened to the under side of the lower XZ base and elongate in the Z axis; and
said steel U-shaped plate having a lower XZ base and two sidewalls.

32. The system as recited in claim 26, further comprising:
at least one rib in the lower XZ base; and
said at least one rib elongate in the Z axis.

33. The system as recited in claim 2, further comprising:
an XZ cross-section in the form of a rectangle; and
said rectangular cross-section having an XZ base equal in width to a lower XZ base.

34. The system as recited in claim 33, further comprising:
a structural securing member fastened to the lower XZ base and elongate in the Z axis.

35. The system as recited in claim 34, further comprising:
said securing member comprises a rod secured to the under side of the lower XZ base and elongate in the Z axis.

36. The system as recited in claim 34, further comprising:
said securing member comprises a rod secured to the inside surface of the lower XZ base and elongate in the Z axis.

37. The system as recited in claim 34, further comprising:
said securing member comprises a steel plate fastened to the under side of the lower XZ base and elongate in the Z axis.

38. The system as recited in claim 34, further comprising:
said securing member comprises a steel plate fastened to the inside surface of the lower XZ base and elongate in the Z axis.

39. The system as recited in claim 34, further comprising:
said securing member comprises a steel U-shaped plate fastened to the under side of the lower XZ base and elongate in the Z axis; and
said steel U-shaped plate having a lower XZ base and two sidewalls.

40. The system as recited in claim 34, further comprising:
at least one rib in the lower XZ base; and
said at least one rib elongate in the Z axis.

41. The system as recited in claim 1, further comprising:
said first part having an area for screws to secure said first part to said second part; and
said second part having an area for screws to secure said second part to said first part.

42. The system as recited in claim 1, further comprising:
material for said first and second parts comprising steel.

43. The system as recited in claim 1, further comprising:
material for said first and second parts comprising fiberglass.

* * * * *